US005224852A

United States Patent [19]

Eden

[11] Patent Number: 5,224,852

[45] Date of Patent: Jul. 6, 1993

[54] WASTE GAS BURNER

[76] Inventor: Robert D. Eden, 2 Crackley Cottages, Kenilworth, Warwickshire, United Kingdom, CV8 2FG

[21] Appl. No.: 920,991

[22] Filed: Jul. 28, 1992

[30] Foreign Application Priority Data

Aug. 9, 1991 [GB] United Kingdom ..... 9117253

[51] Int. Cl.[5] ..... F23D 21/00

[52] U.S. Cl. ..... 431/116; 431/202

[58] Field of Search ..... 431/202, 115, 116

[56] References Cited

U.S. PATENT DOCUMENTS 2,857,961 10/1958 Brown et al. ..... 431/116
3,933,420 1/1976 Zink et al. ..... 431/202
3,985,494 10/1976 Childree ..... 431/202

*Primary Examiner*—Carroll B. Dority

*Attorney, Agent, or Firm*—Ware, Fressola, Van Der Sluys & Adlolphson

[57] ABSTRACT

A waste gas burner (10) comprises burner means (12) into which waste gas is fed through injectors (15), each leading to an open end of a conduit (17) to cause natural aspiration of primary air (20). The primary combustion takes place in a reaction zone (19) surrounded by a peripheral wall (16) which is pierced by ducts (23) so as to introduce recirculated combustion products under natural draught. Secondary air intakes (25) surround the peripheral wall (16) of the reaction zone (19) and promotes secondary burning of the recirculated gases. The reaction zone has a high temperature short duration combustion without excess air and the secondary combustion takes place at a lower temperature with a longer retention time and in the presence of excess air so as to reduce nitrogen oxide formation and ensure combustion of impurities in the waste gas.

14 Claims, 2 Drawing Sheets

WASTE GAS BURNER

BACKGROUND OF THE INVENTION

1. Field of the Invention

This invention relates to a burner for waste gases such as those which are generated by decomposition on landfill sites at which refuse is deposited. Such waste gases consist principally of inflammable methane gas but which may also contain other gases having a higher or lower degree of flammability, vapours and dust, any of which may be composed of or contaminated with biologically dangerous chemicals. It is necessary to dispose of the waste gas efficiently since otherwise there is a risk of explosion or uncontrolled burning and it is also necessary to ensure that any harmful contaminants are rendered harmless so as to avoid environmental pollution and health hazards.

2. Description of the Prior Art

The techniques previously used for burning waste gas have been derived from the technology developed in the incineration of domestic waste. Municipal and similar large-scale domestic waste incinerators use high chimneys and rely on the production of a high temperature, between 1100° C. and 1200° C., for a long residence time, typically of the order of two seconds. It has been found that this relatively long period of burning at the appropriate temperature is needed to ensure that complete incineration of the refuse occurs without the formation of environmentally harmful oxides of nitrogen in substantial quantities.

However, the burning of waste gas is not completely analogous to the burning of domestic refuse and it is therefore to be supposed that the same criteria will not apply. Nevertheless, it is customary for waste gas burners to use relatively long retention times and temperatures in the same region, 1200° C., as in refuse incinerators.

SUMMARY OF THE INVENTION

The formation of nitrogen oxides is a complex matter. Nitrogen oxide formation depends partly on temperature and partly on retention time and is also related to the presence of excess air. It is an object of the present invention to provide a new or improved waste gas burner capable of producing reduced emissions of harmful environmental pollutants including nitrogen oxides.

According to the invention there is provided a waste gas burner comprising, gas injector means;

primary air aspirator means at said gas injector means;

burner means adapted to burn said gas in said primary air to create, in a reaction zone, a high temperature short duration combustion;

recirculation means for natural draught recirculation of combustion gases to a secondary combustion zone surrounding said high temperature reaction zone;

and natural draught secondary air intake means to said secondary combustion zone, the arrangement being that secondary combustion occurs in the secondary combustion zone at a reduced temperature in excess air.

The gas injector means may be directed into an end, open to atmospheric air, of a burner conduit, whereby said primary air is aspirated by a chimney effect. The burner conduit may include a venturi.

The reaction zone may have a peripheral shield. The secondary combustion zone may also or alternatively have a peripheral shield.

The burner may have an external casing with a restricted outlet opening and duct means may be provided through said peripheral shield or shields to form the natural draught recirculation means for combustion gases.

The casing may have secondary air inlet means communicating with a region outside the peripheral shield of the reaction zone. The air inlet means may communicate with a region inside the peripheral shield of the secondary combustion zone.

The gas injector means may be moveable towards and away from said end of the burner conduit to adjust aspiration of the primary air.

The secondary air inlet means may be adjustable, for example by means of louvres.

The temperature in the reaction zone may be between 1400° C. and 1600° C.

The retention time of gas in the reaction zone may be less than 0.1 seconds and is preferably of the order of 0.01 seconds or less.

BRIEF DESCRIPTION OF THE SEVERAL VIEWS OF THE DRAWINGS

A waste gas burner embodying the invention will now be described in more detail by way of example only with reference to the accompanying drawings in which.

DETAILED DESCRIPTION OF THE PREFERRED EMBODIMENT

Figure 1:
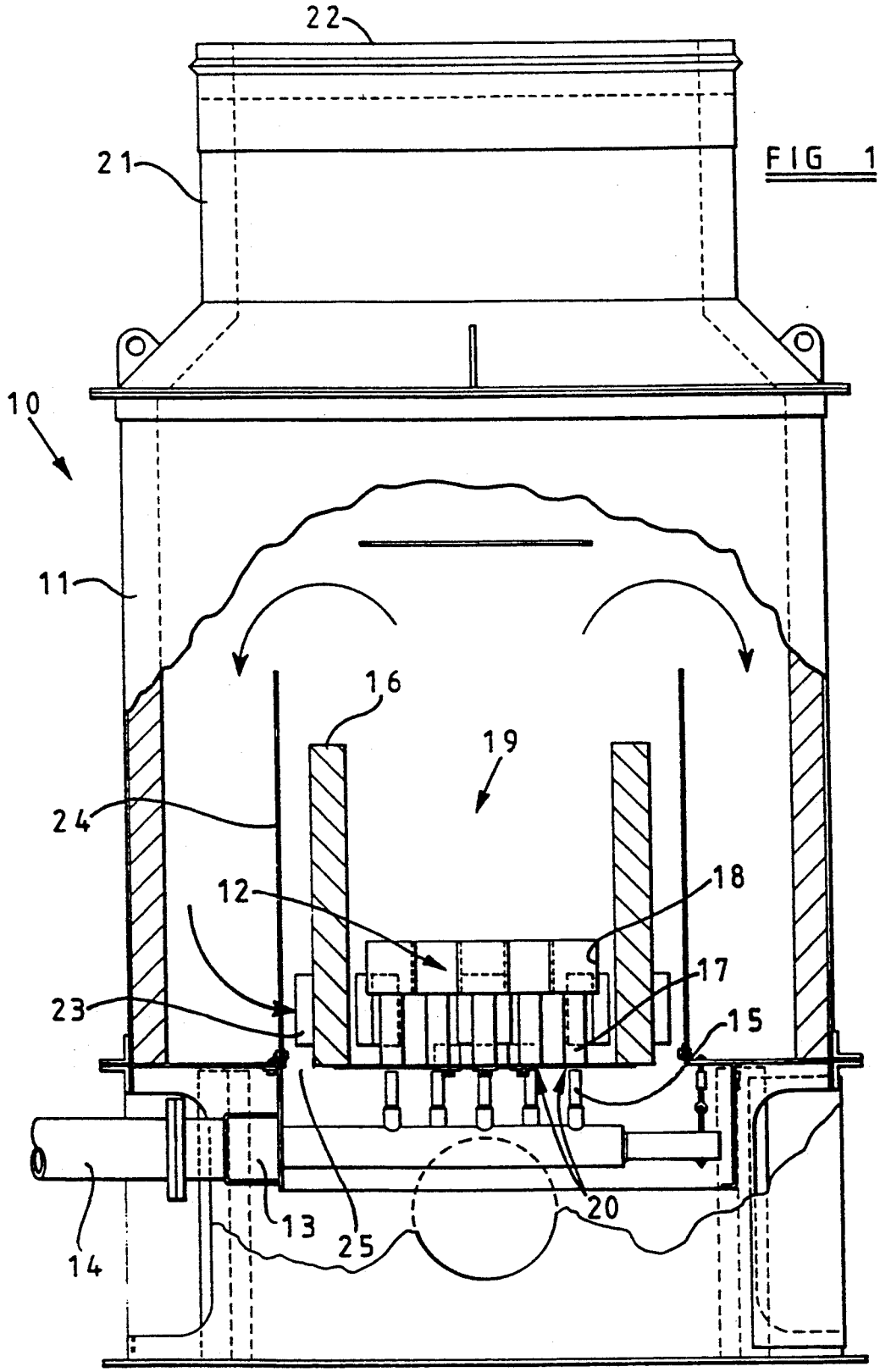
FIG. 1 is a vertical sectional view of a waste gas burner embodying the invention.
Figure 2:
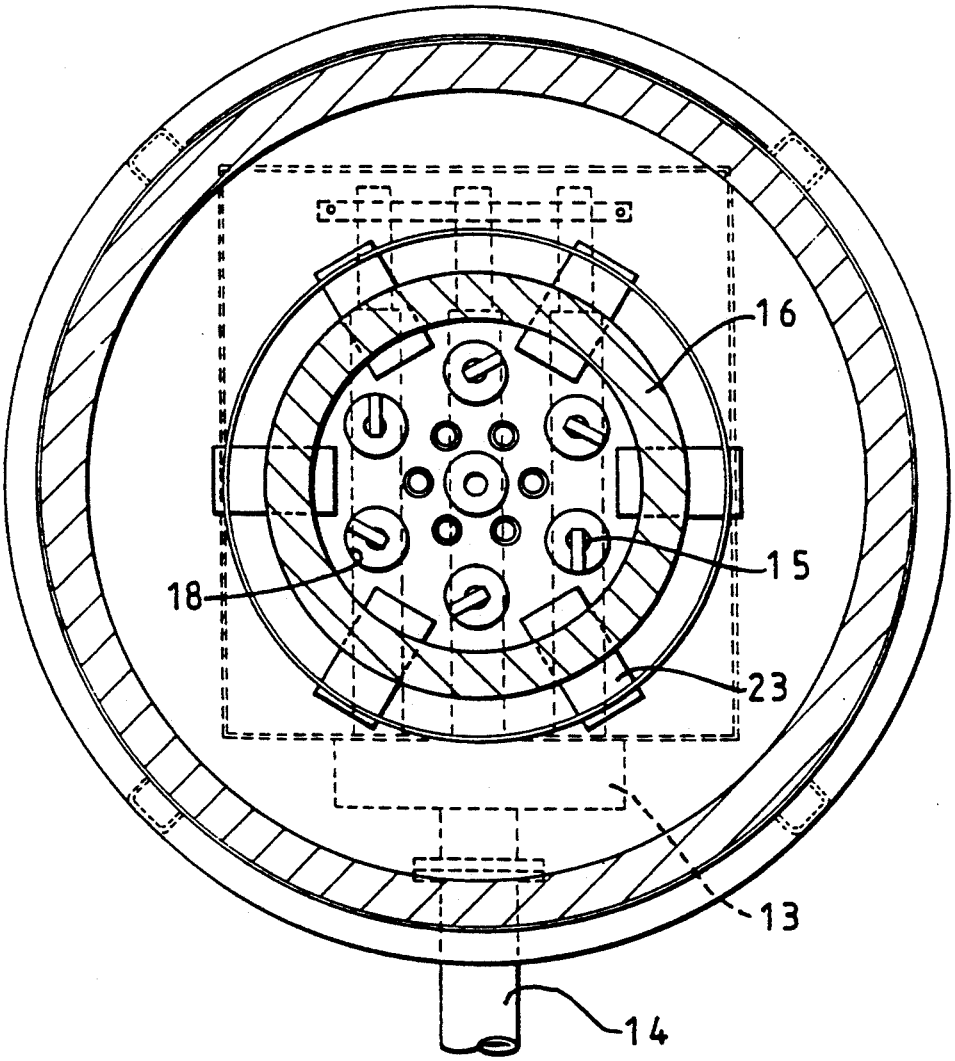
FIG. 2 is a plan sectional view of the burner of FIG. 1.

Referring to the drawings, a waste gas burner is generally indicated at 10 and comprises a casing 11, a burner assembly generally indicated at 12, a waste gas manifold 13 and a waste gas inlet pipe 14.

Waste gas entry through the inlet 14 passes into the manifold and is then fed to a plurality of gas injectors 15. The injectors point upwardly towards a reaction zone encircled by a peripheral wall 16. Both the casing 11 and peripheral wall 16 are insulated with mineral wood or other suitable high temperature insulation.

Each injector 15 faces an end of a burner conduit 17, from which it is slightly spaced. Arrangements may be made so that the spacing of the injector 15 from the conduit 17 can be adjusted slightly.

As gas is injected through the injector into the end of the conduit 17, the ambient air surrounding the conduit 17 is subjected to a chimney effect and is aspirated into the conduit 17 where it mixes with the gas 15 to provide a combustion mixture.

The mixture emerges in a burner cup 18 where it is allowed to spread laterally and mix thoroughly. Suitable ignition means ensure that combustion takes place and a very high temperature short duration combustion takes place in a reaction zone 19.

Thus, the primary air aspirated at 20 together with the gas to be burnt creates a primary high temperature combustion in the reaction zone 19. The temperature may desirably be in the region of 1400° C. to 1600° C., and is therefore several hundred degrees higher than the conventional 1100° C. to 1200° C. used in currently available waste gas flare systems. The duration of this primary combustion is of the order of 0.01 seconds and is certainly less than 0.1 seconds.

The burner cups 18 prevent lift-off of the flame due to imbalance between the flame propagation rate and the speed of issuance of gas.

The casing 11 has a restrictor hood 21 through which combustion products can emerge at 22. However, because of the restricted size of the hood 21 compared with that of the casing 11, a back pressure is created.

This back pressure, coupled with the strong suction effect at the injectors tends to recirculate the combustion gases which pass out of the reaction zone 19, over the top of the peripheral wall 16 as indicated by the arrows and return to the region of the burner assembly 12 through passageways 23.

Surrounding the peripheral wall 16 of the reaction zone, there is a further, non-insulated peripheral all 24 which serves to define a secondary combustion zone. Air is drawn into the secondary combustion zone through its open lower end at 25. This secondary air intake can be controlled by louvres (not shown) disposed below the burner assembly.

The recirculated gases are fed through the passageways 23 to surround the high temperature reaction zone 19. They are then forced upwardly and meet the secondary air as it emerges between the peripheral walls 16 and 24, giving rise to further combustion stages.

The recirculated combustion gases are cooled by the secondary air so that the secondary combustion takes place at a much lower temperature than that which occurs in the reaction zone. Also, because of the use of natural draught to draw the secondary air in at 25 and the recirculated combustion gases into the combustion zone, the residence time of the gases during secondary combustion is much greater, of the order of one second, than the residence time in the high temperature reaction zone.

Present gas burners may be of a pre-aerated type producing a short clear flame or a non-aerated type in which oxygen mixes only after the fuel gas exits the burner port. The flame is long and combustion is incomplete.

By the use of chimney effect at the injector 15, natural aspiration can add approximately 40% primary air into the gas stream. By means of thorough mixing using the conduit 17 and burner cup 18 to create turbulence, it is believed that a flame temperature in the region of 1500° C. can be achieved in the reaction zone and this will provide more rapid destruction of toxic emissions than in the lower 1100° C. to 1200° C. used in currently available waste gas flare systems. This enables the use of relatively short and compact burner flues, reducing costs and also reducing the visual impact on the environment.

It has not hitherto been attempted to recycle the combustion gases in a waste gas burner and it is believed that, combined with the high temperature quick initial burning, the use of recycling and low temperature secondary combustion in the presence of excess air will reduce the amount of nitrogen oxide ultimately released into the atmosphere, as well as optimising the destruction and removal efficiencies related with specific toxic pollutants.

The apparatus provides a relatively inexpensive and compact burner for waste gases.

I claim:

1. A waste gas burner comprising, gas injector means;

primary air aspirator means including said gas injector means; means forming a primary combustion chamber adapted to burn said gas in said primary air to create in a reaction zone a high temperature short duration combustion;

recirculation means for natural draught recirculation of primary combustion gases to a secondary combustion zone formed between said primary combustion chamber and wall means surrounding said primary combustion chamber;

and natural draught secondary air intake means to said secondary combustion zone, the arrangement being such that secondary combustion occurs at a reduced temperature in excess air.

2. A burner according to claim 1 wherein the aspirator means includes a burner conduit.

3. A burner according to claim 2 wherein the burner conduit includes a venturi.

4. A burner according to claim 1 wherein the primary combustion chamber includes a first peripheral wall.

5. A burner according to claim 1 wherein the wall means forming the secondary combustion zone includes a second peripheral wall.

6. A burner according to claim 4 wherein the burner includes an external casing with a restricted outlet opening and duct means are provided through said second peripheral wall to form said natural draught recirculating means.

7. A burner according to claim 4 wherein the casing has air inlet means.

8. A burner according to claim 5 wherein the primary air aspirator means and said natural draught secondary air intake means are connected to a common manifold.

9. A burner according to claim 2 wherein the gas injector means is moveable towards and away from said end of the burner conduit to adjust the aspiration of primary air.

10. A burner according to claim 7 wherein the secondary air inlet means are adjustable.

11. A burner according to claim 10 wherein the adjustment of the secondary air inlet means is by means of louvres.

12. A burner according to claim 1 wherein the means forming the primary combustion chamber create in a reaction zone a temperature of between 1400 and 1600 degrees Celsius.

13. A burner according to claim 1 wherein the means forming the primary combustion chamber create in a reaction zone a high temperature combustion having a short duration of less than 0.1 second.

14. A burner according to claim 13 wherein means forming the primary combustion chamber create in the reaction zone a high temperature combustion having a short duration of less than 0.01 second.

* * * * *